US009861942B1

(12) United States Patent
Paul et al.

(10) Patent No.: US 9,861,942 B1
(45) Date of Patent: Jan. 9, 2018

(54) VIRTUAL ORIFICE BUBBLE GENERATOR TO PRODUCE CUSTOM FOAM

(71) Applicant: Rarelyte Corporation, Charlestown, MA (US)

(72) Inventors: Benjamin J Paul, Winchester, MA (US); Elizabeth P Lofton, Lock Haven, PA (US); Cyrus Vatan, Carlisle, MA (US)

(73) Assignee: Rarelyte Corporation, Charlestown, MA (US)

( * ) Notice: Subject to any disclaimer, the term of this patent is extended or adjusted under 35 U.S.C. 154(b) by 81 days.

(21) Appl. No.: 15/186,872

(22) Filed: Jun. 20, 2016

(51) Int. Cl.
*B01F 3/04* (2006.01)
*B01F 5/02* (2006.01)
*B01F 15/02* (2006.01)

(52) U.S. Cl.
CPC ..... *B01F 3/04446* (2013.01); *B01F 3/04* (2013.01); *B01F 3/0412* (2013.01); *B01F 3/04113* (2013.01); *B01F 5/02* (2013.01); *B01F 15/026* (2013.01); *B01F 15/0237* (2013.01); *B01F 15/0245* (2013.01); *B01F 15/0247* (2013.01); *B01F 2003/04148* (2013.01)

(58) Field of Classification Search
CPC ..... B01F 3/04; B01F 3/04106; B01F 5/02
USPC ..... 261/121.1
See application file for complete search history.

(56) References Cited

FOREIGN PATENT DOCUMENTS

JP 2002191950 A * 7/2002

* cited by examiner

*Primary Examiner* — Robert A Hopkins
(74) *Attorney, Agent, or Firm* — Clocktower Law; Erik J. Heels; Michael A. Bartley

(57) ABSTRACT

A controlled, high throughput custom foam generator is disclosed which has the ability to generate foam with varying cell characteristics. The generated foam can be two or three dimensional with controlled gas volume ratio, void sizes, placement and distribution in a matrix. Additionally the device can create individual bubbles or bubble strings. The device streams two or more fluids creating one or more virtual orifices that generate uni modal bubbles displaying crystalline behavior. Unlike known prior art, the device embodies simple controls to easily alter and scale the nature of generated foam. The generator can be single, or be part of an array of generators. The ability to easily alter the resulting bubble and cell composition allows the creation of engineered foams of any structure and packing with controlled foam features such as weight, strength, opacity and persistence; thus making it suitable for a wide variety of applications.

25 Claims, 10 Drawing Sheets

VIRTUAL ORIFICE BUBBLE GENERATOR TO PRODUCE CUSTOM FOAM

CROSS-REFERENCE TO RELATED APPLICATIONS

None.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Copyright 2016, Rarelyte Corporation.

BACKGROUND

Field of Technology

This relates to an improved method of bubble generation, and more particularly to devices for generating bulk quantities of perfect bubbles and custom foam.

Background

Currently, applications of bulk bubbles and foams have only roughly controlled sizes and distributions, especially for voids in the micron or sub micron size regime. It is preferable that precise control of all of the constitutive properties of the bubble making fluids, as well as control of foam characteristics including void size, void fraction (foam dryness or gas ratio), void placement and foam persistence in a two or three dimensional structure, could be designed to optimize function of the foam.

Making perfectly controlled droplets is an area of microfluidics which has been of interest for several decades. Creating perfect droplets (or bubbles) allows the ability to process and handle very small volumes of chemicals and deliver them in precise concentrations. The process allows for metering, mixing and dilution of tiny volumes for applications in biology (synthesis of biomolecules, cell simulation); medical (lab on a chip for diagnostic testing or point of patient care, drug delivery systems); and chemistry (organic synthesis with high throughput using less reagent volume and short reaction times). Another interesting application area is droplet size control to maximize (or minimize) chemical wetting characteristics. This has utility in very diverse areas such as coatings for microelectronics and lubrication in mechanical grinding and wetting of fibers.

Making size controlled bubbles allows the creation of engineered or custom foams. Crystalline behavior of size controlled bubbles allows the self organization and packing into preferred foam structures. This allows the user to exploit foam characteristics to control time of persistence or to optimize end use properties of the foam such as strength versus weight of the foam.

Applications to date have been limited by an inability to scale robustly performing arrays. A high throughput droplet generator would greatly expand the potential areas of usage. This is difficult when making droplets from two incompressible liquids. Making controlled size, high throughput bubble generating arrays has the further complication of using a compressible gas.

It is generally easy to create single bubbles or high throughput foams such as fire fighting foams, bubbles and foams from toys, soap dispensers or shaving creams; or even consistently shaped bubbles to observe streamlines in a second fluid, as long as an average size and distribution of bubbles is acceptable. Having a controlled void size and fraction, with designed void packing in two or three dimensions through a foam allows one to optimize final foam properties such as toughness, flexibility, strength, weight, opacity and insulative properties, thereby adding value to foaming applications or microfluidic chemical delivery.

However a number of problems historically arise if one tries to make crystalline bubbles to create bulk foams with controlled void size(s), fraction and packing with microfluidic devices. These problems include:

1) Low throughput for bulk applications
2) Delivery of non pulsating fluid feed streams
3) Mechanical orifice wear
4) Control of surface wetting characteristics of channel walls
5) Increase in fluid shear load occurring at the interface where fluid one meets fluid two
6) Pressure drop occurring at the orifice from dimensional restriction of the fluid channels
7) Non distinct, different regimes of droplet formation depending on experimental conditions creating multiple size modes from identical orifices
8) Back pressure control downstream of the orifice and affect on bubble generation
9) Crosstalk between bubble generators in an array creating transient pressure variations
10) Potential need for an additional carrier fluid
11) Controlling multimodal bubble formation from a scalable array of individual generators for custom foams in two or three dimensions There are many applications where chemicals are spray applied for use as visual coatings, cleaning agents, crop protection (from pests or weather conditions), fertilizer, temporary masking, ice and snow control, dust and erosion control, pesticides and lawn and weed care. Spray applied chemicals are typically supplied in bulk or need to be diluted from a concentrated form with a liquid carrier (water or solvent). The diluted chemical is then atomized with a device to generate a spray or distribution of liquid droplet sizes in order to distribute the chemical over an area. The median droplet size and size distribution are governed by the nozzle type and design as well as spray application variables such as pressure, liquid flow rate and spray angle; (drop size decreases with higher pressure, an increase in flow rate, or an increase in spray angle). Properties of the chemical also affect the droplets. A decrease in viscosity or surface tension will typically decrease the drop size.

Smaller droplet sizes are in some ways desirable as they allow greater surface area coverage while using a smaller volume of the chemical. Using engineering solutions to atomize to smaller droplets requires more energy and more costly application equipment. Decreasing chemical viscosity generally means applying the chemical at lower solids, requiring more water or solvent usage. Reducing surface tension to achieve smaller droplets can be achieved by changing from aqueous to organic solutions, which are flammable or combustible and release volatile organic compounds upon application.

Handling bulk chemicals can be costly and problematic. Large pumps and pipes must be maintained and kept clean in order to prevent bacteria from growing and contaminating the product. Many bulk chemicals need to be stored with continuous agitation in temperature controlled environments. Transportation and storage requires appropriate packaging or bulk tanks to prevent leaks and spills. Secondary containment at 10% of the original container volume is used for bulk storage. Empty packaging must be disposed of (often as hazardous waste), and bulk tanks must be periodically cleaned, creating downtime and additional chemical waste. Freight and warehouse costs have also greatly increased. Given these factors, it would be positive to reduce chemical volume. This suggests that working from concentrates would add value.

Unfortunately, diluting chemicals can often expose the applicator and the environment to hazardous materials. Engineering controls for air handling and personal protective equipment which are routinely used in industrial settings to reduce exposure risk are often unavailable to the chemical applicator. In addition, appropriate containers and mixing equipment are required to dilute properly, and must be cleaned after usage, creating chemical waste. Care must be taken to accurately and precisely measure the concentrate and the carrier liquid for consistent results. In the case of some chemical classes, for instance pesticides, there are legal limits to exposures, dosages and application rates that must be strictly adhered to.

Having low viscosity, low solids chemical formulations means a greater total volume of material is required for the application, and a greater volume of materials must be transported to and from the point of application by the user. The low viscosity chemicals may easily atomize to fine droplets, but then can run or flow away from the intended surface.

Often times the delicate can stability of the concentrated chemical is destroyed upon dilution due to settling or product separation. In these situations any diluted, unused chemical must be disposed of as waste at the end of the day.

Current paint formulations used for zone or field marking contain chemicals which one would prefer not to spray into the environment. Even with the most environmentally safe, low to no VOC formulations, repeated use of fillers such as calcium carbonate compact the roots and can kill the grass. Biocides must be added to paint formulations to keep them can stable, which can enter storm runoff and have adverse effects especially on aquatic life.

Another necessary area of improvement versus today's field marking paint is to have a sharp reduction in water usage. A large volume of water is used to dilute the formulations and additionally to clean the spray apparatus after use. Mixing and cleaning up bulk spray applied field marking paint can be such a deterrent, that many fields are hand painted with aerosol cans. This paint can be extremely flammable and may contain up to 90% solvent since aerosol paint cans are exempt from VOC rules based on volume of the can. It would be very desirable if the bulk volume of the paint coating was inexpensive, safe to handle and safe to release into the environment, inert to living things, and to the soil, water and atmosphere.

Description of Prior Art

Uncontrolled, bulk foam producing devices are quite common. Fire fighting foams create massive quantities of foam, typically using line eductors or self educting nozzles.

These eductors work by the Venturi principle where the rapid flow of the foamable liquid through a constriction creates a pressure drop, combined with an opening to pull air into the line to form foam. Although foams can be created in bulk quantity, and engineered to create different average size cells, they are not controllably mono or bimodally dispersed.

Similar foam generating devices where the foamable liquid is somehow mixed with air and then pressurized through steel wool or other porous material creates foam, often in the micron or submicron size, but not mono dispersed enough to display crystalline behavior.

Another example includes foams that come out of pressurized cans, for example shaving cream or Magic Foam used for transient marking of sports fields. Here a volatile organic propellant or mixture, and a surfactant water mixture is released from the can, which then depressurizes, expanding rapidly, and volatilizing the organic components. These devices create foams that are very polydisperse and transient.

Bubble generating toys and party foam generators do not attempt to control bubble size.

U.S. Pat. No. 2,134,890 (Nov. 1, 1938, H. Redon, "Means for materializing the stream") demonstrates a device to produce bubbles to aid in defining and observing the streamlines of a second fluid, for example the flow of air around a solid body. The device uses small, conical or round chambers where the foammable liquid mixture must wet the sides of the chamber, with the air introduced down the center. The outlet stream of bubbles is carried away by the fluid streamline which is being modeled. Bubble sizes are controlled by pressure control of the air and foammable liquid. Additionally this application to model air streamlines requires the individual bubbles to be visible and buoyant in air. This criterion limits the minimum size bubble. This device also requires an additional air stream used to remove the bubbles at the orifice exit.

U.S. Pat. No. 3,769,833 (Nov. 6, 1973, Ordway et al., "Bubble Generator") teaches an improvement for use in modeling airflows by using a gas lighter than air to form the bubbles, allowing the formation of mass quantities of neutrally buoyant bubbles to be created. The bubble cell size is controlled by the velocity of the external streamline flow, and not readily controlled by the foam generating device. Bubble removal at the exit is done with an additional airstream.

A particular mesh size screen or combination of screens, or a porous membrane can be used to create fairly monodispersed foams. European Patent 1,520,484 (Aug. 26, 2009, Poortinga et al., "Method for obtaining a monodisperse foam, and product obtainable by such method") teaches a very specific use for food foams to create taste sensation in the foamed, cooked product, where the food is pre-aerated to incorporate at least 20% air, and the minimum cell size of the prefoam is more than 5 times the membrane pore size. The porous membrane length has to be at least 30 times longer than the pore size, and the resulting bubble size is about 10 times larger than the pore size. The foammable fluid (food substance) must contain stabilizer, as well as proteins which denature to maintain cell rigidity. For this devise technology to be used in other applications, the pressure drop across the membrane would demand excess energy consumption for the device and would put potentially deleterious shear forces on the foammable fluid.

United States Patent Application 2011/0006086 (Jan. 13, 2011, Yates, "Foam Soap Generator") teaches a foam soap generator for use with various soap and air delivery mechanisms, where air is introduced into the soap at a mixing chamber and forced through a porous passage at the exit to make a "high quality, consistent soap foam."

There is considerable research in the area of making pressure driven microfluidic devices to create mono dispersed emulsions and bubbles from two immiscible fluids. All of the devices function in some way to inject a dispersed phase (fluid one) into an immiscible continuous phase (fluid two). If both fluids are liquids then an emulsion is formed. If fluid one is a gas, discrete bubbles are formed and may be collected as foam. Foam generated from mono dispersed bubbles has increased stability compared to other randomly sized bubble foams, as there isn't a pressure difference between bubbles in contact, severely limiting one mechanism of foam coarsening. If two partially or fully miscible fluids are used, the same device can be used for mixing or dilution, with or without the further addition of an immiscible fluid to make a second phase.

Technical research has focused in large part on the phenomena occurring at the fluid one and fluid two interface, and ways to control the droplet frequency, size, modality and volume fraction of each phase. Additional fluids may also be introduced, and multi-level emulsions of droplets within droplets have been demonstrated.

The devices typically have co-axial fluid flow (co-flow, flow focusing or T-junction types), but counter current devices also exist. The two fluids are delivered from pressurized reservoirs in the necessary proportions into micro channels of various geometries. The two fluids are forced together and capillary instability breaks up the steady stream into droplets.

In a co-flow device, the two immiscible fluids are pumped into a micro channel in parallel. Fluid one expands along the channel into fluid two until a neck is formed. The width of the neck decreases as it flows downstream, eventually breaking off. T-junction geometries are attractive because they have the potential to utilize existing fabrication techniques.

The T-junction geometry allows more control and has been extensively studied. With these devices, the two phases flow through separate channels, and come together perpendicularly (T, or 45 degree for Y) to form droplets. Droplets of the dispersed phase are created from the sheer force and the interfacial tension at the surface of the two fluids. By controlling the pressures in the laminar flow regime, mono dispersed droplets maybe produced in these T-junction micro channels. Studies have shown that the size of the droplets depend on many factors such as the size of the micro channel, the relative liquid flow rates, the surface tension, surfactant type and concentration and the viscosity of the continuous phase.

Generally single bubbles occur with high liquid flow rates, and turning up the gas velocity to create a dryer output allows coalescence of air bubbles (termed the slug regime). This approach is limited if one is trying to make mono dispersed bubbles, strings or foams with a high volume fraction of air. Droplets can be produced at frequencies of a few kHz with a T-junction device.

It is a fairly robust process to generate mono dispersed bubbles in a counter flow, or co flow single droplet device generator made of glass. A cylindrical capillary glass tube is heated and pulled to create a saddle configuration. This tube is then matched to fit snuggly into a square glass capillary to obtain an axi symmetric constriction with diameters on the order of 50 to 350 microns, for precisely measured lengths. These rigid tubes flow focus two immiscible fluids, for instance air in water with an additional surface active chemical (surfactant) to make bubbles. This device has been demonstrated to provide mono dispersed bubbles at a high air volume fraction (up to 90%) that have crystalline behavior, with gas flow rates up to 500 mL/hour. This is several orders of magnitude higher than in literature described Polydimethylosiloxane (PDMS) devices.

Given the artisan glass approach to making the device, it would be very challenging to configure many of these independent devices, each constructed with the same orifice volume, and deliver each device the same pressure of each fluid in order to generate larger, bulk quantities of unimodal bubbles or emulsions. Glass devices also fracture easily and are not that robust for industrial applications.

Another type of microfluidic device uses flow focusing to create monodispersed droplets, where the continuous phase fluid is pumped in and around a central channel containing the immiscible fluid of the dispersed phase. Both fluids are then forced through a downstream, concentric, narrow orifice, where the continuous phase fluid must be able to wet the orifice walls. The dispersed phase flow becomes narrow and breaks into droplets.

Unfortunately, the behavior of droplet formation is very dependent on experimental conditions, and four different droplet breakup regimes have been identified (squeezing, dripping, jetting and thread formation). Garstecki et al. ("Formation of Bubbles and Droplets in Microfluidic Systems", Bulletin of the Polish Academy of Science, Vol. 53, No. 4, 361-372, 2005) review the published data to date and corresponding device geometries. They conclude that the rate of liquid flow and the device geometry determines the bubble formation mechanism. They show that nonlinear behaviors occur resulting in irregular bubbling, dependent upon the experimental conditions. They further propose ("Mechanism for Flow-Rate Controlled Breakup in Confined Geometries", Physics Review Letters, Vol. 94, Issue 16, Apr. 29, 2005) a mechanism for flow rate controlled break up with confined geometries (i.e. conditions at low Weber numbers).

Raven et al. ("Dry Microfoams: Formation and Flow in a Confined Channel", The European Physics Journal B, 51, 137-143, May 31, 2006) report dry microfoam creation. They also demonstrate significant back pressure effects from the foam, as they increase foam volume by going from wet to dry. During this transition they note four distinct bubble regimes, dripping, bidisperse, and bubbly alternating to bamboo shaped foam as air volume fraction is increased. They also report ("Foams in Microfluidics", 18th Congres Francoais de Mecanique, Grenoble, Aug. 27, 2007) that there are strong discontinuities in the bubble flow rate with a varying number of bubbles in the exit channel.

So far there is not enough information or a tool that allows one to predict for specific device geometries, fluid combinations and volume throughput what droplet size and generation frequency there will be, or under what conditions the transitions between the break up regimes will occur, due to the large number of experimental variables. This is true even for devices producing just one droplet stream.

Single flow focusing devices have demonstrated bubble generation frequencies upwards of 100 kHz. Nanoparticles instead of surfactants can be used to stabilize perfluorocarbon gas filled bubbles with a high single device droplet generation frequency. A flow focusing, PDMS device with a high pressure gradient across the bubble channel can generate similar bubble frequencies.

For all devices, controlling the wetting properties of the channel walls is essential. The continuous phase needs to easily wet the orifice channel surface, but the dispersed phase should not. For example to create an aqueous foam of air, the walls must be hydrophilic, versus to encapsulate an aqueous phase with oil, the orifice walls need to be hydrophobic. PDMS is typically used for fabricating micro channels because it has positive performance attributes such as being transparent, easy to fabricate with, and it is flexible. The surface of PDMS is hydrophobic and needs to be surface modified by grafting on more hydrophilic polymers, such as polyacryl acid (pAA) or polyethylene glycol (PEG), or by treating with oxygen plasma (though this is just a temporary fix) in order to generate droplets where the continuous phase is aqueous. The surface energy is appropriate for PDMS channels with hydrophobic, organic materials in the continuous phase, but the PDMS can swell up in this media and distort the channels and make non-homogeneous droplets. PDMS also has a low elastic modulus, which limits the manufacture of micro channels with very small dimensions.

An alternative class of polymers is fluoropolymers, which have improved chemical compatibility vs. PDMS. In this case, fabrication is difficult as fluoropolymers do not adhere well to other materials. This subsequently limits use of these devices at high pressure or temperature.

Attempts have been made to produce larger volumes of foams or emulsions from micro fluidic devices by running them in parallel. Soft lithography PDMS fabrication techniques allow for a convenient route to manufacture such devices. In one study, (Stoffel et al, "Bubble Production Mechanism in a Microfluidic Foam Generator", Physical Review Letters, American Physical Society, 108, pp. 198302, 2012) 256 T-junctions were fabricated to run in parallel, with the highest throughput reported of a single channel of 4 kHz. This research focuses on the bubble production mechanism, notes the complexity of this, and determines that "detailed geometry of the device is critical in determining device performance."

Multiple droplet formation devices have all of the single droplet device challenges, as well as the issues of cross talk between droplet generators that can occur either up or down stream of the device orifices, adversely effecting mono-dispersity. Exactly the same amount of each fluid must be precisely delivered to each droplet generator in order to create mono dispersed foam or emulsions across all of the generators. The transient pressure variation created during the formation of any single droplet can influence the pressures at the surrounding droplet generators and alter the droplet formation.

A device made with six parallel flow focusing devices with single inlet channels for the continuous oil phase and dispersed aqueous phase, with each having a separate outlet tube, produced mono-dispersed droplets within each single exit, but had variation in droplet size across all six exits. Varying the length of the exit tubes varied the back pressure to tune in the size and frequency of each singlet generator.

This issue of crosstalk and size variation is particularly problematic when the dispersed phase is a compressible gas as opposed to an incompressible fluid as above. Stoffel et al further concluded that the scaling up of parallel devices is "not trivial due to the different coupling mechanisms between individual generators . . . requires complex devices with non planar topologies."

Flow Focusing Inc has a system that attempts to solve the scaling of multiple parallel devices. In their work "a funnel shaped lens of gas is created when a flowing gas produces a pressure drop across an orifice. By introducing a flow of liquid into the mouth of this funnel, a steady, thin jet of liquid is created which rapidly breaks up into small droplets of very similar size. Because the liquid is guided by a lens of gas, the liquid jet never touches the hole through which it flows. In fact, the hole size is selected so as to create a desired pressure drop at an optimal gas flow and can be many times the diameter of the liquid jet." This process creates homogeneous, single phase, essentially unimodal droplets in a dispersing fluid (two fluids total).

Flow Focusing Inc has demonstrated that multiple fluids delivered through concentric nozzles can be used within the gas lens to make encapsulated liquid droplets, or hollow spheres. This process creates two phase, unimodal droplets with a core shell morphology in a dispersing fluid (three fluids total). They further claim that they can scale this technology by putting many such devices in parallel.

Flow Focusing Inc further claim making micro gas bubbles with this technology, and have demonstrated "60 micron air bubbles of uniform size were made using 15 kPa air pressure through the nozzle and a focusing fluid consisting of 20% ethanol and water exiting into water." They demonstrate the creation of individual bubbles through a method for fluid aeration, but not creation of dry strings or foams. Their technology works and keeps separated mono dispersed droplets by creating the droplets in a dispersing fluid.

U.S. Pat. No. 9,056,299 (Jun. 16, 2015, Romanowsky et al., "Scale-up of Flow-Focusing Microfluidic Devices") teaches an improved method for flow rate and fluid ratio control using multi planar, parallel flow focusing devices. This attempts to minimize crosstalk and to evenly distribute fluid flow by having multiple, fairly large volume fluid inputs to each individual droplet generator. This method of delivering fluid coupled with a pressure drop occurring at the orifice by having a dimensionally restricted portion located before the outlet can create droplets or foams, mono, bi or polydispersity controlled. Any fluid which degrades with the application of shear would suffer in the dimensionally restricted area with the pressure gradient.

None of the above examples provide a route to making a portable, durable, low energy consuming device, with very consistent, non-pulsating fluid streams, which is capable of making, in significant quantities, uni-modal or controlled bi or multi modal bubbles, strings, or two or three dimensional foam structures in readily scalable arrays, with gas volume fraction control creating wet to very dry foams and without exhibiting significant orifice wear issues. What is needed, therefore, is a product that overcomes the above-mentioned limitations and that includes the features enumerated above.

BRIEF SUMMARY

Bulk quantities of perfect bubbles (exhibit crystalline behavior) can be generated by forming each bubble in a dynamically created, virtual orifice located externally to the bubble generator. This allows the manufacture of arrays of many closely spaced, bubble generators in order to create custom, engineered foams. The virtual orifice is created by the gas flow and by the designed geometry of the exit channels of the bubble generators. This virtual orifice decouples the inlet fluid streams, eliminating fluid stream crosstalk and pressure variations, making the bubble generation extremely stable. This enables control of foam characteristics such as cell size, distribution and packing, as well as gas fraction and chemical composition in two or three dimensional structures, to optimize foam properties for particular end use applications.

By eliminating the need to pressure match fluid flows at the interface of the two immiscible fluids in the bubble generators, continuously stable bubble creation can be maintained. This also eliminates the requirement to maintain pressures within the associated limits of device orientation. Decoupling the fluid inlet streams further allows operation at significantly lower power levels than existing devices. Device pressures can be reduced by a factors of 10 to 100, with a consequent reduction in the power required to operate the device. In certain applications, this allows for devices powered by internal combustion engines to be converted over to run off batteries.

There is need for bubble generators without back pressure control issues that adversely impact scalability either up or down stream of the orifice. Such a generator may be constructed from dimensionally stable materials which are easily wetted by the fluids, without mechanical design elements which increase shear load on the encapsulating fluid. Furthermore, such arrays may function without the need for carrier fluids. The principle vectors of the array, the construction materials and the manufacturing process may be readily set to allow easily obtaining desired output droplet characteristics, as bubbles, strings or two or three dimensional, foams of controlled cell sizes as required by the user.

A bubble or foam generator can be made from a single bubble generator or from a readily scalable array of generators, along with the necessary ancillary equipment required to deliver the fluids. This device is capable of creating bulk quantities of defined, controllable bubbles and foams with sizes down to the micron or sub-micron regime. Size control is excellent enough to create uni-modal bubbles demonstrating crystalline behavior. The generator or array of generators is constructed from flat stock utilizing conventional cutting techniques or 3D printing. The bubble forming orifice is mathematically definable, and is located remotely and virtual to each of the individual bubble generators in the array. The orifices are created dynamically by the flow of fluid one, and by the designed geometries of the exit channels of the bubble generators. This advantageously decouples the input fluid streams, eliminating the need for high pressure delivery systems, the existence of bubble generation cross-talk, interference and instability in parallel device arrays, and issues associated with orifice wear. The device allows the end user to define desired bubble cell characteristics such as void size(s), volume fraction, and packing in a high throughput system. The device allows production of bulk bubbles & foams with precisely controlled void sizes in the micron & sub micron size regime. Further, one or more than one liquid and/or gas can be piped to the array to create and control two and three dimensional foam structures. Foam properties such as time of persistence, opacity, chemical concentration, insulative value, toughness, strength, flexibility and weight reduction can be optimized for particular end use applications.

Bulk foams can be used to replace temporary coatings, allowing the reduction of material usage (for instance, solvent or water carriers, fillers for opacity, chemical containers etc) and minimizing raw materials, shipping costs and waste disposal. The concentrated, liquid chemicals maybe precisely delivered to the foam generator from a flow controlled, closed system, with dilution occurring from ambient air at the point of application. This eliminates pouring, mixing and dilution, and subsequently exposure and clean up by the operator. The volume fraction of the air is adjusted to control the liquid chemical concentration and to get the required coverage such that the necessary macroscopic properties of the coating are maintained.

For low viscosity liquid formulations, low pressure ambient air (less than 1 PSI) is metered by a separate air motor with an inline flexible reservoir. No costly compressed air systems and gas valves are required. Power consumption to run the entire foam generator is low since the fluid streams are decoupled and do not continuously build resistance at a physical orifice. This allows the use of a battery operated system, as opposed to a traditional gas engine for example. All of the equipment and chemicals required to create bulk controlled foam are therefore portable and may be carried or mounted on a robot or other vehicle and used in remote locations.

Features and Advantages

A single bubble generator (or each individual generator in an array) creates a virtual orifice. This eliminates any nozzle wear that occurs in generators with a mechanical orifice. The droplets are formed after the materials have exited the physical generator, without the need of a carrier fluid. No carrier fluid simplifies the bubble generators and the plumbing of the incoming fluid streams. Having an external orifice decouples the two fluid streams, and no premature mixing can occur inside of the array, regardless of the wetting characteristics of the fabrication materials of the array itself. This allows the use of any two immiscible, foaming fluids to be used in any particular array. The decoupling of the fluid streams also means that there is no need to match fluid pressures at a mechanical orifice, or at the interface where fluid one meets fluid two.

Bubbles forming externally to the array, in conjunction with the resulting fluid stream decoupling means that back pressure events have been effectively eliminated, and do not affect device performance. This means that a single bubble generator is easily scalable in parallel or in three dimensions to create an array of generators that can have a very high throughput, without unwanted cross talk between individual bubble generators in the array. When the two fluid streams are pumped to each virtual orifice, they instantly balance themselves across all of the virtual orifice nozzles. The generators are able to generate consistent foam over a wide range of gas pressures, and the arrays can be tipped or used in any orientation, as small variations in head pressure no longer negatively affect bubble creation.

The virtual orifice bubble generator is easily manufactured with any convenient, dimensionally stable, flat stock; regardless of stock surface wetting characteristics using conventional cutting or 3D printing techniques, and can be readily constructed in parallel to create controlled, higher throughputs. The principle vectors of the bubble generators are mathematically derived making it easy to design, fabricate and produce bubbles of the desired size. By combining multiple bubble generators and controlling the distance between individual ones (each comprised of one fluid two channel and its array of concentric fluid one channels) one can make anything from individual or strings of bubbles, or move the generators closer and create foams of unimodal cell size. By still further concentrating the bubble generators, or by increasing the fluid one flow rate, a bimodal, ordered foam may be created, due to interference of one fluid one cone with an adjacent fluid one cone. With three dimensional device arrays, multimodal cell sizes maybe produced.

Bi and multi modal foam can also be created by purposely altering the orifice characteristics of some but not all of the bubble generators in an array, to alter the composition of the generated foam while eliminating or minimizing interference patterns from adjacent generators.

The single generator or an array are much less sensitive to gas pressure variations then are conventional, mechanical orifice, micro fluidic flow focusing bubble generators and may be operated in any orientation. They are not sensitive to head pressure variations. Also with decoupled fluid streams, low gas pressures can be used which is inherently safer for the operator. This also means that common pumps, for instance piston pumps, may be used to drive the gas stream. A flexible reservoir may be incorporated between the gas pump and the array of generators to smooth and maintain a reasonably constant, non-pulsating gas pressure. This results in more stable, robust bubble generation.

The incoming fluid two stream channel has a specifically designed geometry to balance flow across one or more generators, without restrictive pressure gradients in the channels. This allows the use of common liquid pumps, for instance a peristaltic pump, to drive the liquid flow. This geometry, in addition to giving excellent liquid metering precision to the bubble generator or array, allows a much wider choice of foammable fluid mixtures than a conventional microfluidic device does. Any foammable fluid or mixture, (from low to high viscosity), Newtonian or shear sensitive, as well as appropriately sized suspensions, emulsions or nanoparticles flow readily through the device. With laminar flow rates with sufficient fluid volumes to reach an array of bubble generators, behavior at one generator doesn't impact the behavior at surrounding generators unless one purposely designs the geometry, sizes and flow rates to insure cross talk between fluid one spray cone patterns.

If an array of generators is used, different foammable liquid streams can be pumped to specific generators in the array at the same time. The virtual orifices of these specific sites maybe engineered to produce the same or different size bubbles from the other generators in the array to take advantage of certain structures needed in a specific end use application. Two different liquid streams, foamed to create specific structures or foam packing might include a hard and a soft liquid component, or a two part crosslinking system in order to control the weight and strength, or opacity for example of the resulting foam.

All of these features combine to enable the device to be battery operated with very low power consumption, when used with low viscosity liquids. In addition, the device including the necessary fluid pumps, flexible gas reservoir, fluid inputs, array of generators and virtual nozzles can be packaged together to be easily portable.

A micro-fluidic bubble generator delivery system for chemicals also eliminates the need for the end user to dilute and mix the chemicals, which is a potentially hazardous handling operation. Dilution and mixing can be accomplished by tuning the bubble size, and controlling the pressure of fluid one and the flow rate of fluid two.

The device also allows micro-fluidic mixing, dilution and delivery of multiple, different fluid two streams, which may be soluble or insoluble with each other. This affords the end user a mechanism to safely handle concentrated, potentially hazardous chemicals at the point of use.

The final structure of an air and chemical combination allows satisfactory performance in the end use application while also affording a reduction in the material quantity or active element; as well as processing energy and clean up typically required in that application. This is extremely positive from an environmental standpoint.

Air may act as a diluent and a carrier to the concentrated fluid formulation, significantly reducing the need for water or solvent.

Performance attributes of the gas and bubble size may be utilized to add performance value as well as a reduction of necessary material quantity.

Use of pigments and fillers can be significantly reduced or eliminated by tuning the foam void size and distribution to render the foamed coating opaque and highly visible.

Dispersants used to distribute fillers and pigments may be eliminated from the formulation with a coating opacified by air.

Rheology modifiers can be significantly reduced or eliminated, or replaced with less hazardous materials since formulations without high density fillers do not need rheology modifiers to maintain in-can stability. Additionally, purposely entrained air in the foamed coating provides the runoff, slump, sag and spatter resistance required in the end use application.

Without the need for fillers and rheology modifiers, energy intensive, high speed mixing is not needed to manufacture the formulations.

Since air can be purposely entrained at the point of use, the volume of the packaged foamable fluid coating can be significantly reduced compared to conventional coatings. This reduces container sizes and bulk plastic waste streams, as well as storage and shipping costs.

Formulation manufacturing techniques that do not require high speed mixing do not entrain unwanted air in the formulation, and defoamers can be eliminated from the formulation.

The reduction of materials and simplified formulations allows for alternate methods of product manufacture. With careful control of order of addition of low viscosity fluids, the ingredients of concentrated fluid formulations can be added directly to an end use container. Following procedures currently employed in the food and beverage industry, fluid formulation can be packaged and sealed without the use of additional biocides and remain resistant to biological growth and contamination in the container.

Filling and mixing directly in quart containers reduces waste, chemical cleaning agents, water and solvent usage in manufacturing. Formulation ingredients and order of addition to the end use containers may be such that no bulk batches need to be produced and no physical mixers are required to touch the formulations, therefore no manufacturing equipment needs to be cleaned.

Concentrated chemical formulations, used from small containers, can be precisely and accurately metered from a sealed delivery system. The formulations may be diluted at the point of application using a gas, preferably ambient air. The volume fraction of the gas may be adjustable to control the chemical concentration and to get the required coverage such that the macroscopic properties of the chemical coating are maintained.

This allows much smaller volumes of chemical to be accurately delivered over large surface areas. In addition, lower volumes may be shipped and stored, and packaging waste kept to a minimum. The chemical applicator does no pouring or mixing and therefore requires no engineering controls or personal protective equipment in order to safely handle the chemicals.

An application for using controlled bulk foam is in formulations of disinfectant or cleaners for use on artificial turf fields. Turf fields need to be cleaned and disinfected periodically to control dust and to eliminate the viruses and bacteria that grow on the turf and infill. Disinfectants can pose serious health risks to the chemical applicator and to the users of the field, so that the fields are typically shut down while the chemicals are applied and dried adequately, until once again it is considered safe to play on. Or worse, the fields are not shut down, exposing players to disinfectant or cleaners that have not sufficiently dried. Disinfectants are diluted typically with large volumes of water before application. With controlled, bulk foams, the air acts as the diluent insuring that the correct disinfectant dosage is applied to the turf, preferentially delivered from a closed system using ambient air so that there is no exposure to the chemicals. The formulation may be modified such that the air stays entrained in the solution for an adjustable amount of time (i.e. the foam stability is controlled) so that the disinfectant is delivered to the intended target. Since substantially less water is used, the total time to apply and dry is reduced.

With controlled, bulk foams, further modification of the chemical formulation may take advantage of one or more properties of the incorporated air. The air void size and volume fraction may be controlled such that they render the formulation opaque. In this case, having uni-modal size of the voids increases persistence of the foam. This improves over distribution of void sizes which tends to coarsen foam and pop individual bubbles/cells since different void sizes also have different void pressures, and foam naturally equilibrates.

The chemical formulation may also include materials to stabilize the foam, as well as a polymer or other film forming material to set the dried applied foam, such that white marking lines with a definable persistence are created. These formulations may be prepared as concentrates, used in low volumes, thereby saving water; and without necessarily adding fillers such as calcium carbonate or titanium dioxide. These formulations may also be dyed or pigmented in order to make colored lines.

Bulk controlled foams may also be used for dust control at construction sites, or in agriculture or roadside applications or at race tracks. In such applications it is advantageous to use less water and keep the areas from getting muddy, while still controlling dust with a foam blanket.

Bulk controlled foam formulations may be used to deliver anti- or de-icing chemicals to roads, parking areas or walkways. In the case of anti-icing chemicals, a hygroscopic solution, for example of magnesium chloride is striped onto the road surface. The salt releases heat when mixed with water. This property, and freezing point depression, allows the road surface to resist icing at lower atmospheric temperatures then regular road salt or sand allows. The coating also functions to make the ice and snow form a weaker bond with the road surface, which allows easier snow removal and less resulting damage to the road surface. The physical incorporation of air in stable foam weakens the road ice interface, and aids in subsequent ice removal.

Using a bulk, controlled foam, herbicides and pesticides may be precisely and accurately delivered at the correct dosage, without dilution or exposure to the applicator. In such applications, the lifetime of the foam may be tuned to give the chemical sufficient body so that it does not run off of or away from the intended target.

A bulk controlled foam may be applied to function as a barrier to moisture or for the insulative properties of the foam, with a tunable time of persistence. For example, this is advantageous to protect crops from freezing.

Another application for a bulk controlled foam is creating insulative blankets for evaporation control. Such blankets may be rapidly created at the point of use without using a physical cover; for instance for pools.

The bubble generator to create very controlled foams also allows very accurate and precise dilution and metering of chemicals and/or pharmaceuticals. Further, unimodal bubble sizes display interesting rheological properties, allowing self assembly of mono layers, or perfect packing in three dimensions. An example applications for this includes creating a surgical blanket of foam, created at the incision point to deliver antibiotic. Blood coagulating medicine may also be delivered to a wound at the injury site in precisely metered, tiny amounts.

Similarly, controlled bulk foams have utility in application areas that currently use foams, but where more precise control of the foam characteristics allows further property optimization. Foams are applied in many ways, such as moving the foaming fluid relative to the surface being treated (by aerosol can, wand or hose, or motorized applicator); by moving the substrate relative to the foam generator (for instance, continuous web applications); or in three dimensional applications with or without a mold.

Having controlled, precise and accurate void sizes, gas ratios and void distributions and placement (i.e., designed, preferred void packing in two or three dimensions) through a foam allows optimizing final foam properties such as toughness, flexibility, strength, weight, opacity, and insulative properties, thereby adding value to current foaming applications, no matter how the foam was previously fabricated.

Controlling the liquid delivery system to the foam generator allows incoporating multiple engineered liquids to the foam; all while maintaining void fraction, size, and distribution in the foam. For example, this allows incorporating hard and soft chemicals into the same matrix, or reactive chemical systems of different liquids and/or reactive with the void gas.

In all application areas, a coating or foam persistence maybe desired which is longer or more durable then that obtained from foam size control alone. For example, one may desire a film forming system. The film forming polymer or inorganic system (for example cement) may simply dry, or be set or cured by a destabilization mechanism when exposed to air or another gas, or by using ionic, thermal, multi part chemical or energy curable chemistry. The gas chosen for the void fraction may be reactive with the liquid to chemically set the foam. One example is if the gas is the acid carbon dioxide, and the liquid is a solution of sodium or potassium silicate.

A process for preparing a foaming composition may improve foam stability because the mono-dispersity of the foam limits coarsening and extends the foam's persistence time. The foam stability maybe further improved by using a liquid composition that dries, sets or cures the foamed coating, with or without dilution with water or solvents included in the liquid composition.

BRIEF DESCRIPTION OF THE DRAWINGS

In the drawings, closely related figures and items have the same number but different alphabetic suffixes. Processes, states, statuses, and databases are named for their respective functions.

DETAILED DESCRIPTION, INCLUDING THE PREFERRED EMBODIMENT

Figure 1:
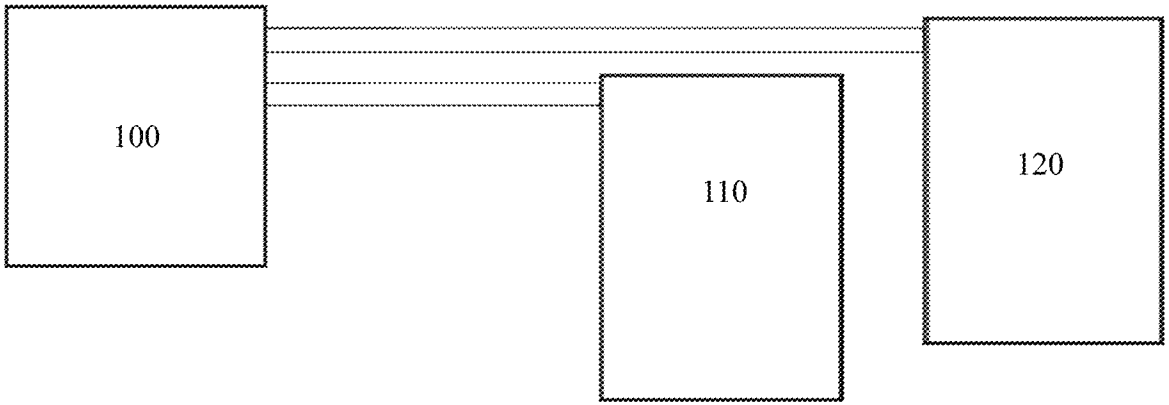
FIG. 1 is a diagram of a micro-fluidic bubble generator device with two separate, precisely metered, immiscible fluid inputs.

In the following detailed description, reference is made to the accompanying drawings which form a part hereof, and in which are shown, by way of illustration, specific embodiments which may be practiced. It is to be understood that other embodiments may be used, and structural changes may be made without departing from the scope of the present disclosure.

Terminology

The terminology and definitions of the prior art are not necessarily consistent with the terminology and definitions of the current disclosure. Where there is a conflict, the following definitions apply.

Bubble generator—a physical apparatus with one designed set of channels and reservoirs, including a central fluid two channel with exit in plane with exits of a conical arrangement of fluid one channels, but excluding peripheral tubing, pumps and fluid sources.

Device—a system comprising one bubble generator or an array of bubble generators, the necessary fluid feed containers, the ancillary equipment required to power and pump the fluids, and the virtual orifices dynamically created by the channel designs of the generators and the flow of fluid one.

Input—describes any area of the system including pumps, reservoirs, channels that are upstream of the device exit.

Channel—the physical grooves or pipes that carry fluid one and fluid two to the exit of the bubble generator.

Reservoir—a place where fluid collects.

Virtual Orifice—an area, existing outside the physical bubble generator, not due solely to the physical generator construction, through which both fluid one and fluid two must pass when co-axially delivered from a bubble generator to form bubbles; acts as an exit opening dynamically created by the flow of fluid one through the device, and due to carefully designed parameters for channel sizes and orientations ($\theta_{bg}$, $D_{bg}$, and $D_{f2}$), and fluid one composition and input conditions.

$\theta_{bg}$—specifies the angle off center used to deliver fluid one to create the virtual orifice.

$D_{bg}$—specifies the diameter of the circular arrangement of fluid one exit channels around the fluid two exit channel.

$D_{f2}$—specifies the fluid two exit channel diameter.

Array—a purposely designed arrangement of individual parallel bubble generators, configured to deliver bulk quantities of individual bubbles, or two or three dimensional foams as required for desired performance in an application.

Droplet—the output of the bubble generator when the gas fraction is approaching zero, i.e. the bubble is substantially liquid.

Dispersity—a measure of the heterogeneity of the bubble sizes.

Mono dispersed—the condition where the device has created droplets having uniform enough size to exhibit crystalline behavior such as self assembly of mono layers with specific packing.

Uni, bi or multi modal bubbles—having one, two, or more designed and controlled bubble sizes.

Emulsion—a fine dispersion of minute beads of one liquid which are not soluble or miscible with the surrounding continuous phase.

Operation

Referring to FIG. 1, co-axial, flow focusing, bubble generator 100 has two separate, precisely metered immiscible fluid inputs. Fluid one 110 is a gas, preferably air, and fluid two 120 is an engineered, foamable liquid or emulsion containing a surface active component.

Figure 2:
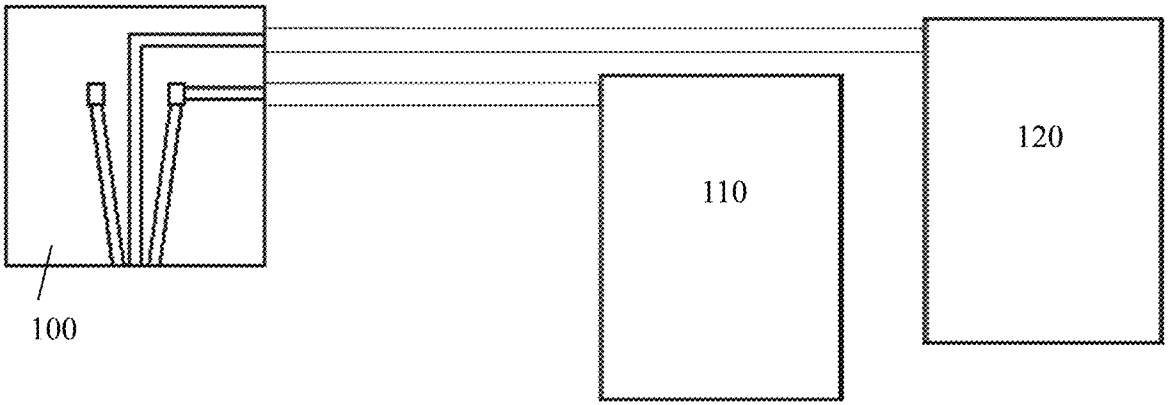
FIG. 2 shows a vertical cross section of the bubble generator device.

Referring also to FIG. 2, viewing a vertical cross section of bubble generator 100 at its midpoint shows that fluid one 110 and fluid two 220 never contact within the physical device.

Figure 3:
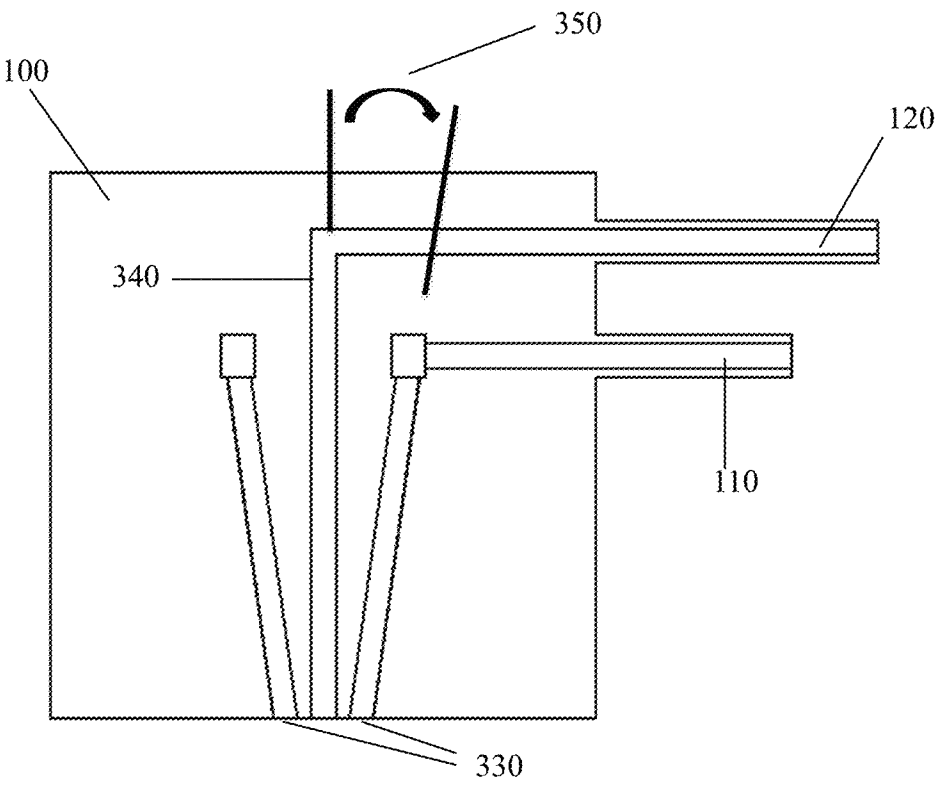
FIG. 3 shows an enlarged view of the cross section of the bubble generator of FIG. 2.
Figure 4:
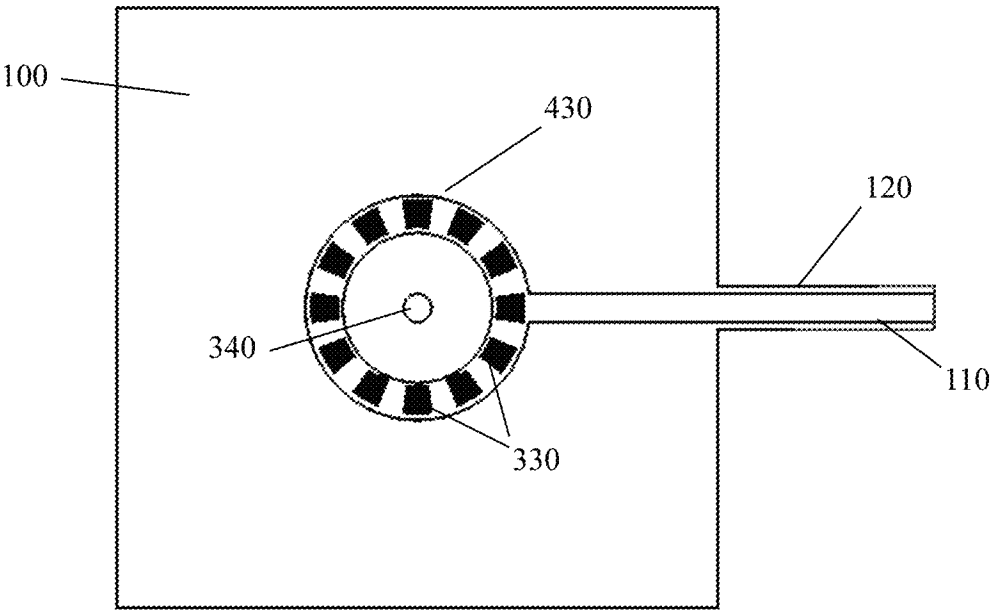
FIG. 4 shows a horizontal cross section depicting the circular distribution ring feeding the converging micro channels for fluid one and the central fluid two channel.
Figure 5:
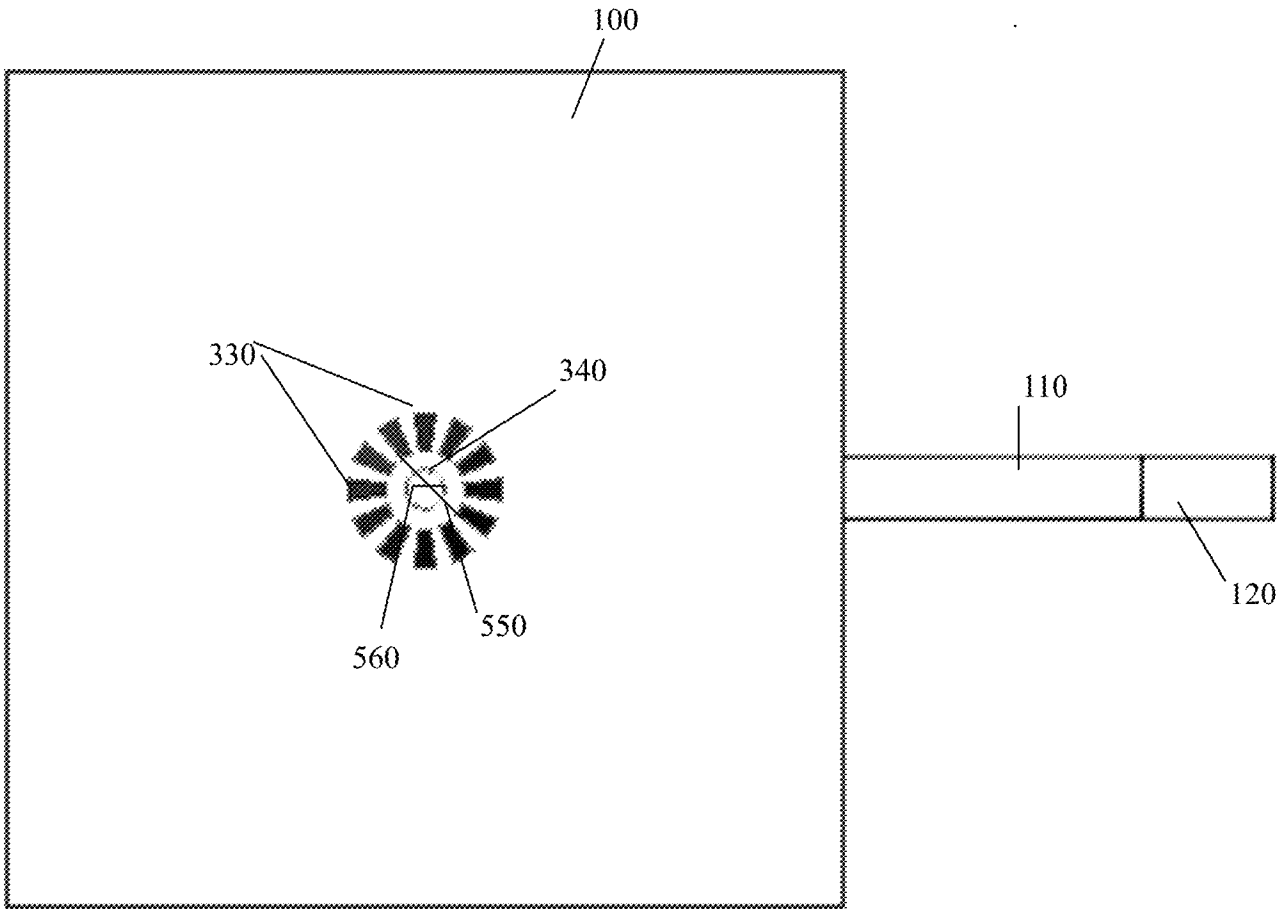
FIG. 5 shows a bottom view of the bubble generator.

Referring also to FIGS. 3-5, operation of bubble generator 100 involves feeding fluid one 110 at a constant pressure through a concentric ring of converging channels 330. The fluid one input stream fills a number of microchannels 330 arranged around, and converging towards the coaxial and central fluid two channel 340. The converging channels of fluid one are all fed from circular reservoir 430, and are configured similarly to the sheath gas nozzles used in aerosol jet printing. Simultaneously, a constant flow of fluid two 120 (e.g. surfactant in water) is maintained through centrally located channel 340. Fluids one and two exit the bubble generator planarly in close proximity to create a flow focused virtual orifice that generates uniform bubbles of controllable size and characteristics.

The size of the generated uni-modal bubbles is determined by the dimensions, angles and geometry of the immiscible fluid channels, and specific input conditions and characteristics of the fluids. The size of the bubbles is given by:

$$D_{bubble}=K*((d_{bg})^3/(4*\tan(\theta_{bg})))^{1/3}$$

where $D_{bubble}$ is the diameter of the generated bubbles,

K is an empirical constant dependent on fluid characteristics, such as viscosity, $D_{bg}$ is the diameter of the convergent channel ring at the exit plane, and $\theta_{bg}$ is the angle of convergence of each concentric channel.

This means that by altering the geometry of the device and/or the characteristics or delivery of fluid one and/or fluid two, one can manufacture bubble generators that create specific diameter, unimodal bubbles. Diameter 550 of the convergent channel ring in the generator exit plane, $D_{bg}$, and/or angle of convergence 350 of each concentric channel, $\theta_{bg}$, are altered to control bubble size. A typical gas angle $\theta_{bg}$ of the current invention is ~8 degrees. Diameter 560 of the fluid two exit channel, $D_{f2}$, along with the flow rate of fluid two and the pressure of fluid one are used to control the gas ratio of the resulting bubbles.

The polydispersity of the bubbles is so low that the created bubbles exhibit preferred packing and crystalline behavior. The device produces significant and useful quantities of uni-modal bubbles with precise control over bubble size and gas volume fraction, from wet to very dry.

The device allows the control of wetness independent of the drop or bubble size by altering flow rates. For example, in generating foam, the generated bubble size is $D_{bubble}$. By feeding more liquid, $D_{bubble}$ stays the same while the wall thickness increases, thereby producing a wetter foam. In the extreme, the foam bubble becomes a drop.

Figure 6:
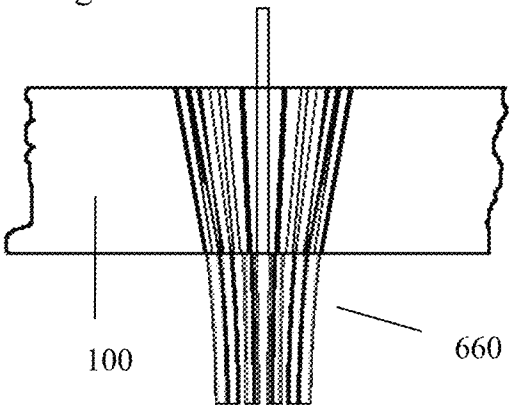
FIG. 6 shows a virtual orifice external to the bubble generator.

Referring also to FIG. 6, the the flow of fluid one exiting the bubble generator from the microchannels dynamically creates a narrowing cone or 'virtual orifice' 660. This virtual orifice is located externally to bubble generator 100, with geometric similarities to micro fluidic flow focusing devices. The narrowing cone of fluid one encapsulates a volume into which fluid two is precisely metered to form each bubble. The utilization of the virtual orifice decouples the interaction of the fluid streams while also decoupling the pressure and regulation of each fluid, and results in very stable bubble generation. This decoupling eliminates the known issues, associated with conventional micro-fluidic flow focusing devices, that typically occur at the interface where fluid one and fluid two meet.

The decoupling eliminates the need to match fluid pressures at a mechanical orifice. This in turn eliminates the continuous pressure build up experience in existing devices and the increasing shear load on fluid two during extended operation. It minimizes the power required to operate the device over extended periods of use. The decoupling also increases the range of useful fluid two compositions or mixtures to include more shear sensitive materials (e.g. emulsions). Furthermore, mechanical orifice wear is not an issue in generators of the current design and no additional carrier fluid(s) are required for the generated bubbles.

Figure 7:
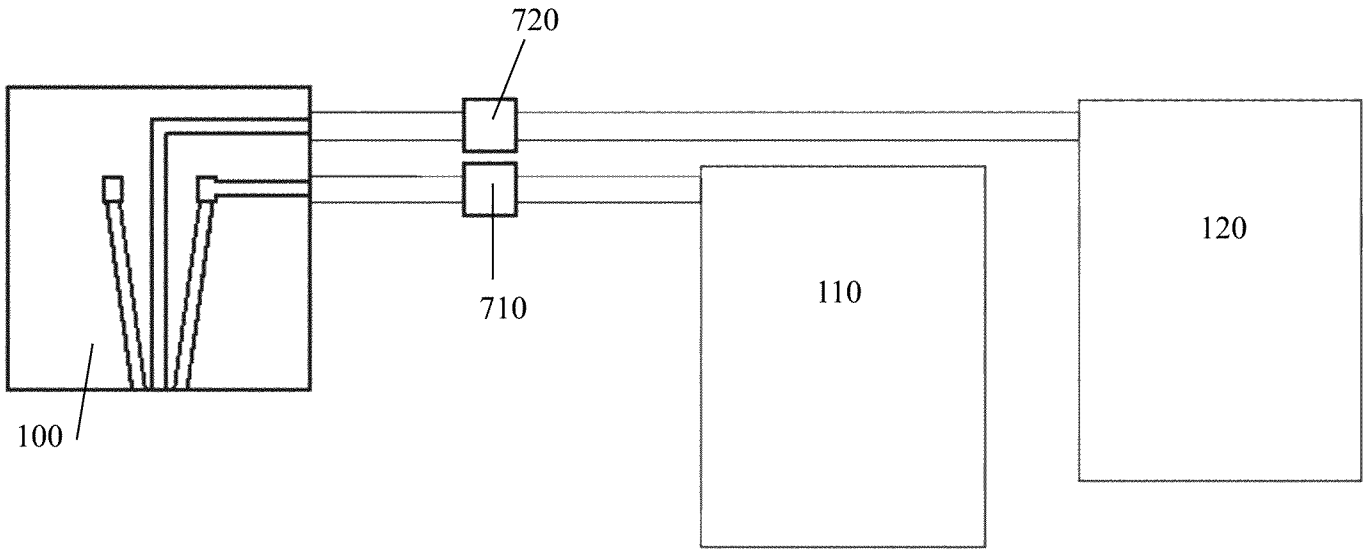
FIG. 7 shows the unimodal bubble generator with fluid pressure and flow controls included.

Referring also to FIG. 7, a very useful consequence of the decoupling of the fluid streams is that it is now operationally simple to turn bubble generator 100 on and off as required. On/off switches 710 and 720 may be included in line with both fluid one 110 and fluid two 120 streams. Pressure regulators and/or flow rate regulators may also be included on either or both fluid streams, either separately or integrated as part of the on/off switches.

The decoupled generators do not have fluid one/fluid two interfaces where fluid one can backfill into fluid two channels or vice versa. This eliminates issues related to surface wetting characteristics of channel walls. Also, when the bubble generator is turned on using known fluid settings for flow and pressure, the conditions to create the necessary bubble stability regime are consistently initiated, thus creating, uni-modal bubbles on demand in the desired quantity.

In preferred examples, the liquid fluid two is delivered in concentrated form from a pre-filled container using standard lab Clearflex 60 Premium PVC tubing. The flow rate is controlled with a laboratory Aladdin AL-1000 Programmable Syringe Pump. Fluid one enters the bubble generator, which was created using 3D printing to create the fluid channels in plastic. Fluid two then fills the centrally located channel. Ambient air is delivered at the necessary volume by using a Powermate electric air compressor and air tank in conjunction with a Fairchild 72010 NKR model pressure regulator. The fluid two stream may be turned on and off by the controls on the syringe pump. The fluid one stream may be turned on and off by using the pressure regulator, or alternately by means of a laboratory stopcock inserted inline in the flexible tubing.

The device input channel dimension $D_{bg}$ 550 and angle $\theta_{bg}$ 350 for fluid one is determined based on the parameters needed for the end use application. One preferred embodiment, for instance, uses fluid one input channel dimensions $\theta_{bg}$ of eight degrees, with $D_{bg}$ of 1.45 millimeters and fluid two exit channel diameter $D_{f2}$ 560 of 0.54 millimeters.

For functional use of controlled bubbles in high throughput applications it is desirable to create integrated systems of bubble generators (an array) as opposed to having many individual generators. Given the robust operating characteristics of the single decoupled fluid bubble generator described above, it is readily scalable to an array of generators. Decoupling the fluid streams has eliminated the known issue of crosstalk and instability between conventional generators when combined in an array. Crosstalk creates transient pressure variations across individual generators, degrading bubble size control in arrays of conventional flow focusing.

Figure 8:
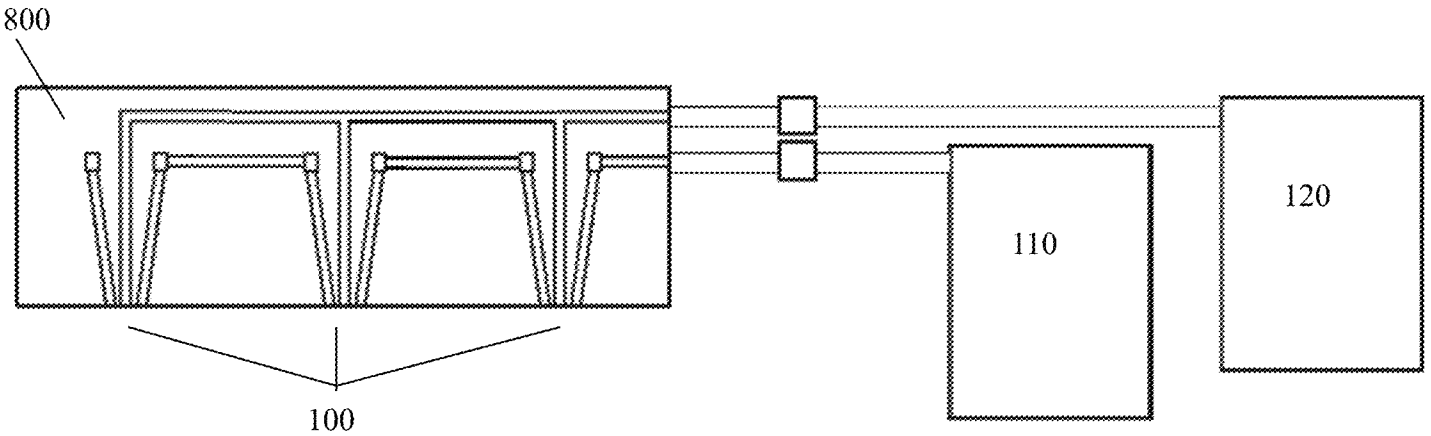
FIG. 8 shows an array of three bubble generators all creating unimodal bubbles.

Referring also to FIG. 8, array 800 may be fabricated joining multiple bubble generators 100 (three shown in the figure for illustration purposes). The channels for the fluid one 110 and fluid two 120 have equivalent design parameters $D_{f2}$, $\theta_{bg}$, and $D_{bg}$, such that the output from the entire array is uni-modal in size and crystalline in behavior.

The co-axial, flow focusing, bubble generator can be effectively combined into large arrays provided sufficient feeder channels and reservoirs to ensure each bubble generator receives an equivalent flow of fluid two and pressure of fluid one. Since each bubble is formed in the dynamically created orifice and not at an interface where fluid one meets fluid two within the physical array, regulation of the incoming fluid streams is decoupled from each other and there is no interference between the bubble created at one generator from those created at the other two generators. This creates very stable, precise bubble generation across the array.

Figure 9:
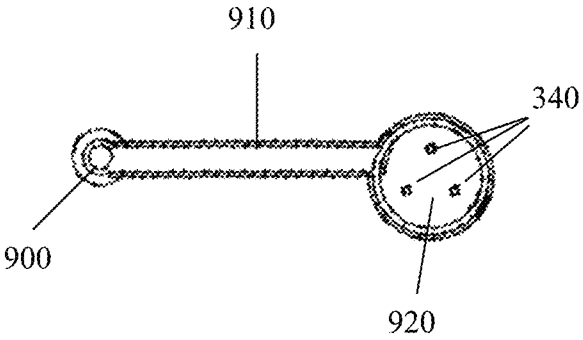
FIG. 9 shows fluid two delivery to each bubble generator.

In preferred examples of the decoupled array, liquid fluid two is delivered from a source of concentrated form using standard lab Clearflex 60 Premium PVC tubing and a Kamoer LLS Plus laboratory peristaltic pump, but any style liquid pump can be used. Referring also to FIG. 9, the liquid enters distribution channel 900 with dimensions on the order of 0.25" diameter in a 3D plastic printed array of bubble generators. Distribution channel 900 directly feeds a smaller diameter, constricted channel 910. The fluid two constriction is built inline to dampen the flow rate variation of fluid two. Fluid two then enters circular reservoir 920, which feeds the central channels 340 of the individual bubble generators.

Channel size should not be overly constricted at any point so that the shear load on fluid two does not increase. This minimum size limitation depends on the chemical composition of fluid two. For example, large, solvent soluble molecules, charged systems or other molecules that have a driving force to self assemble into larger aggregates or micelles, emulsions (which may be electronically or sterically stabilized such that true particle size and the actual size when swollen in the continuous phase of fluid two maybe quite different), etc. all have a different minimum channel dimension in order to flow without a build in shear load.

For an array of bubble generators, fluid one may be delivered with an air compressor and pressure regulator as described above, or more portable pressure controlled systems may be utilized. For example, this can be accomplished with a compressed gas tank and bleed approach. For applications where fluid one is air, a motor driven piston pump has been used. A flexible reservoir such as a rubber balloon may be inserted inline between the pump and the bubble generator array to dampen pressure fluctuations. Flexible PVC tubing may carry air to a 3D printed bubble generator array and fill a distribution channel having a 0.25" diameter. This fluid one distribution channel then fills each circular reservoir feeding concentrically arranged fluid one exit channels of each individual bubble generator.

Figure 10:
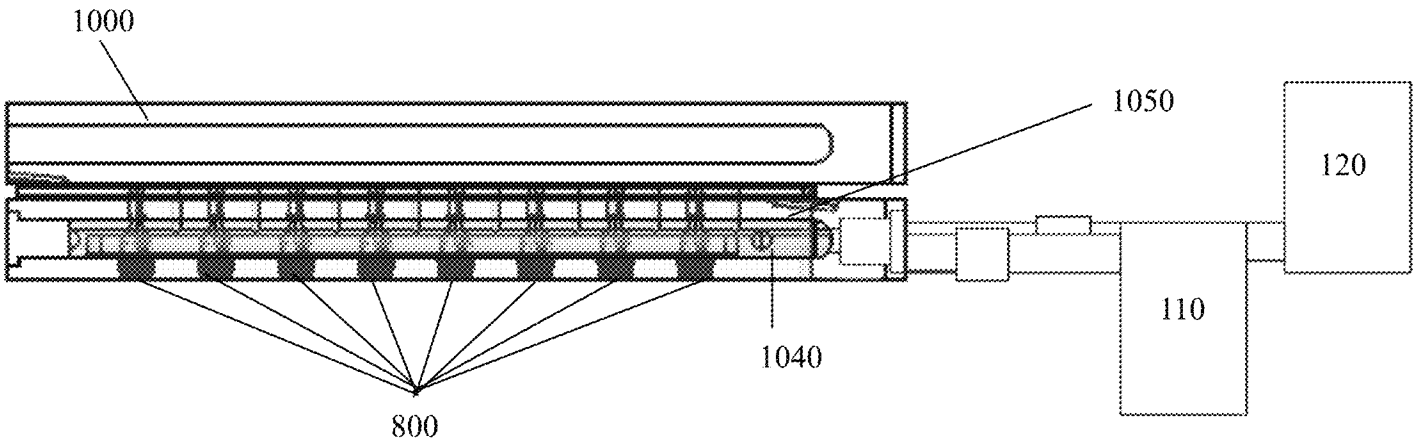
FIG. 10 shows a three dimensional foam generator.

The array of bubble generators can easily be scaled. One example is to scale sets of three generators in parallel. Referring also to FIG. 10, one example is array 1000 of twenty-four (24) individual bubble generators, constructed as eight sets of three bubble generators 800 in parallel. In this example, fluid one 110 goes through a 0.25" distribution channel 1040 and feeds all twenty-four sets of converging fluid one channels, by first filling a circular reservoir (as illustrated in FIG. 4) leading to each individual bubble generator. Fluid two 120 passes through 0.25" distribution channel 1050 to simultaneously feed eight constricted flow channels, which branch off perpendicularly to the feeder liquid channel. As illustrated in FIG. 9, each of the eight constricted channels feeds a circular reservoir, with each circular reservoir in turn feeding three individual bubble generators.

This array can create large quantities of individual bubbles. Alternately, a three dimensional foam with unimodal void sizes is created if the sets of three generators are spaced more closely together with separation distances on the order of $D_{bubble}$. If the individual bubble generators are packed even closer still, with separation distances on the order of $<D_{bubble}$, fluid one streams of adjacent bubble generators interfere with each other. This creates a second, smaller bubble size mode, such that the resulting foam has two void sizes. This bimodal size distribution is robust and repeatable.

Orientations of individual bubble generators other than eight sets of three can be manufactured to create custom foams with controlled void sizes and placement. Criteria that need to be maintained for successful array bubble generators include the decoupled fluid stream virtual orifices, feeder and distribution channels that maintain consistent flow of fluid two to each bubble generator, and consistent pressure of fluid one to each bubble generator. The positioning of bubble generators in the array determines whether the array creates bubbles or foam, however individual unimodal bubbles delivered to a flat surface demonstrate crystalline behavior and will self assemble into ordered foams.

Variations of scaled arrays of bubble generators with decoupled orifices may be manufactured using 3D printing techniques. Conventional micro droplet and bubble generators (e.g. flow focusing Y or T junction, etc.) may similarly be designed and manufactured with decoupled orifice designs to produce similarly improved bubbles and foams. The minimum design feature sizes, and therefore the generated bubble sizes, are also dependent upon the fabrication techniques and construction materials used. Alternative to 3D printing, standard or other device fabrication techniques (for instance in creating a PDMS type flow focusing device) may be used to create decoupled orifice generators.

Controlling exit placement or varying geometry at select exits, during printing or manufacturing, allows consistent production of bimodal foams to improve properties. For example, in emulsion chemistry the number of unimodal large droplets might be set at four times the number of unimodal small droplets (an "80/20 packing") in a batch with a typical size regime ranging from 50 nm to 450 nm. This "80/20 packing" with two distinct size modes greatly enhances final properties, for example surface characteristics (i.e. packing at the surface upon film formation), even though the placement of large and small droplets from the bulk liquid in the film formed state is somewhat random. Such "80/20 packing," with ordered structuring of precise and constant bubble and foam sizes, will also allow improvement of current known ratios and resulting properties.

Air and carbon dioxide are preferred gasses for use as fluid one. The bubble generator will also function with other compressed gas compositions delivered from tanks, reservoirs or pumps. Fluid one pressure ranges are preferably within 0.1 to 20 PSI. With high viscosity fluid two compositions, higher pressures may be required to create bubbles.

A wide range of fluid two compositions may be used to create uni-modal bubbles and custom foams for specific end use applications. Solutions, emulsions and suspensions with particle sizes and viscosities ranging over several orders of magnitude are all effective, provided that:

fluid two contains a surface active ingredient to stabilize the resulting bubble;

the liquid readily flows through the device; and the fluid two liquid is more hydrophilic then fluid one.

Some preferred examples for fluid two include, but are not limited to, aqueous polymer systems with solids ranging from 1.5% to 65%, including natural and synthetic proteins, polysaccharides, and polymers and copolymers of vinyl and acrylic esters. These polymers systems may be either anionically or sterically stabilized.

Other materials which may be incorporated into preferred examples of fluid two include, but are not limited to, optical brighteners, dyes, pesticides, herbicides, disinfectants, and cleaners; as well as biological formulations including bacteria and enzymes. Preferred fluid two flow rates are in the range of 1.0 to 100.0 ml/minute per bubble generator.

Preferred device channel dimensions include $\theta_{bg}$ ranging from 4° to 12°, $D_{bg}$ from 0.15 to 3.0 mm, and $D_{f2}$ from 0.05 mm to 1.0 mm. These preferred range may be limited due to 3D printing resolution, but alternative printers or fabrication techniques with current or future improvement in feature resolution may allow construction of devices with critical dimensions outside of these preferred ranges.

The size of the bubbles generated across these preferred ranges is also dependent on the characteristics and parameters of the various fluid two compositions listed above, as well as fluid one and fluid two input conditions. With the preferred dimensions and fluids, a range of bubble sizes from about 25 microns to 5.0 mm in diameter may be generated. With different geometric dimensions and fluid compositions, the bubble generating device will perform over a larger operational space.

Given the ease of scaling up decoupled bubble generators into arrays, and the range of design parameters and compositions available to the end user, custom foam generation of materials with significant engineered value and characteristics may be created. Furthermore, the delivery of multiple fluid two compositions through separate feeder channels to specific bubble generators within an array can generate foams with blended properties. When these compositions dry, set or cure, the resulting foam has specific controlled void sizes in specific designated locations within the generated foam.

Other Embodiments

Different fluids may be used for different application uses. In one application, fluid one is a gas preferably air, and fluid two is a foaming liquid composition containing a material that needs to be delivered to a substrate such as a cleaning agent or disinfectant. In this case the expansion ratio of the foam can be used to control the concentration of the liquid fluid two, as well as the rheology of the foamed coating. An example of this is a foam that is used to hold the chemical against a surface for instance to clean artificial turf fields or wrestling mats.

The process of forming a foam may include aerating an aqueous foaming composition containing a film forming polymer, for example an emulsion polymer of appropriate glass transition temperature, combined with appropriate surfactants, with or without thickeners, stabilizers, or other additives, which dries, sets, or cures to a closed or open celled foam coating. The film forming polymer may simply dry, or be set or cured by a destabilization mechanism when exposed to air or alternate gas, or by using ionic, thermal, two part chemical or energy curable chemistry. Alternately, the gas chosen for fluid one may contain the acid carbon dioxide to chemically set the fluid in liquid two. An example of this includes fluid two being a solution of sodium or potassium silicate.

In another application, a foamed coating composition is altered to deliver anti or de icing chemicals to roads, parking areas or walkways. In the case of anti-icing chemicals, a hygroscopic solution, for example of magnesium chloride is striped onto the road surface. The salt releases heat when mixed with water. This action, and the freezing point depression allow the road surface to resist icing at lower atmospheric temperatures then regular road salt or sand allows. The coating also functions to make the ice and snow form a weaker bond with the road surface, which allows easier snow removal and less resulting damage to the road surface. Formulations with the physical incorporation of the air as stable foam would weaken the road ice interface, and aid in subsequent ice removal.

Another application may apply a foam blanket for dust and erosion control at construction sites, various agriculture sites, or race tracks without using a large quantity of water, and without making the site muddy, or have runoff issues to surrounding areas.

A further alternate application where fluid one is a gas, preferably air, and fluid two is a foaming liquid composition where the coating is delivered for use as temporary insulation for use in crop protection for example.

In another application, fluid one is ambient air, and fluid two is a chemical or chemical mixture (potentially hazardous) with a specific function. In this case, the bubble size and distribution are controlled to minimize exposure to the operator or environment from chemical drift as well as to optimize concentration of fluid one. This may be used for applications such as the dispensing of agriculture and lawn care chemicals like pesticides or fungicides.

Purposeful foaming may opacify hazardous chemicals, that are diluted and mixed in a closed system, so that they can be visualized in an end use application (as opposed to traditional atomized chemical applications for applications such as pesticides or herbicides for example). This prevents unknown exposure to the operator or other people in the environment by touch or inhalation. Having a visible coating is an easy way for the operator to see where material has already been applied, ensuring uniform coverage.

In another application, performance attributes of the unimodal bubbles are utilized to add value. For instance the liquid level and poly-dispersity may be controlled such that the bubbles behave to self-assemble into monolayers. A surgical blanket may be created at the incision point to deliver antibiotic. Blood coagulating medicine may be delivered to a wound at the injury site in precisely metered, tiny amounts.

In another application, chemical foam may be applied to function as an insulative blanket for evaporation control that can be rapidly created at the point of use without using a physical cover. For example, This may used for pools, or as a coating over freshly poured concrete or cement. Concrete and cement require moisture to cure to ultimate strength properties which the formulation could both provide and prevent from evaporating. Ultimately the foam disappears.

Improved foam stability also allows the use of alternate ingredients to create the foam, an increase and/or precise control of the amount of air which can be incorporated in the foam over the time of persistence needed in the application, for instance enhancing whipped egg whites, cream or gelatin in food foams, or increasing air content in baked goods.

In another application, fluid one is carbon dioxide and used with larger draft containers of beer to perfectly foam each glass for proper mouth feel, or to extend the lifetime of the keg, if the beer inside should go flat.

In another application, the device is used to deliver one liquid, or to mix two or more liquids at the point of delivery, where the end use application is not dependent upon the incorporation of the fluid one gas. Instead, fluid one is primarily used to deliver the liquid droplet in precisely metered amounts, and incorporation of the gas is not critical to the end use application. This may be accomplished by either creating a core gas fraction that is small or approaching zero, or by tuning the solubility of fluid one and fluid two such that a created bubble rapidly becomes a smaller liquid droplet as the carrier fluid one diffuses and exits the bubble. In both cases, the size control is still excellent enough for the droplets to display crystalline behavior.

In other applications, engineered foams with optimized structure and properties can be industrially applied in traditional continuous web applications such as tapes, gaskets or gap fillers, traditional sheet foam, or the manufacture of smart fabrics. With controlled, precise and accurate void sizes, gas ratios and void distributions and packing in two or three dimensions, foam properties can be optimized for performance. Additionally, by having more than one fluid two delivery system to the foam generator, multiple engineered liquids can be incorporated in the foam; all while maintaining void fraction, size and distribution in the foam. For example, this allows incorporating hard and soft chemicals into the same matrix, or reactive chemical systems of different liquids, and/or reactive with the void gas. The final foam properties such as toughness, flexibility, strength, weight, opacity and insulative properties can be dialed in, thereby adding value.

In another application bubble "dryness" (gas volume fraction) is controlled to improve foam function. A homogeneous or heterogeneous array of generators in terms of orifice size or placement is configured with fluid streams feeding it such that a layered configuration of foam dryness is created. For example, a foam with increased wetness on the bottom may improve wet out to a substrate. Alternatively, a dryer foam on the bottom may create quick adherence to a substrate, or reduce liquid drainage in the foam, or increase open time on the top surface. Foams with three or more layers may be constructed such as, for example, dryer foam skins sandwiching a more moist foam layer.

In another application, a foamed system can deliver a costly or useful material to surfaces, and have that material more accessible to the end use, and not trapped in the bulk. For example, such materials may enhance the appearance or optical properties of an article, keep adhesion promoters at surfaces, enable drug delivery, disinfect, or preferred position nanoparticles.

It is to be understood that the above description is intended to be illustrative, and not restrictive. Many other embodiments will be apparent to those of skill in the art upon reviewing the above description. The scope should, therefore, be determined with reference to the appended claims, along with the full scope of equivalents to which such claims are entitled.

What is claimed is:

1. A device for creating bubbles comprising:

a first fluid gas;

a second fluid liquid;

a bubble generator having a central channel through which the second fluid flows, and a concentric ring of converging channels arranged circularly around the central channel, the converging channels through which the first fluid flows, and exits from the bubble generator of the central channel and converging channels, the exits in a plane such that the flow of fluid one creates a virtual orifice outside of the bubble generator, the virtual orifice such that bubbles are formed as fluid two flows through the virtual orifice; and wherein the size of the bubbles is $$D_{bubble}=K*((d_{bg})^3/(4*\tan(\theta_{bg})))^{1/3}$$

where $D_{bubble}$ is a diameter of generated bubbles,

K is an empirical constant dependent on fluid characteristics, $D_{bg}$ is a diameter of the convergent channel ring at the exit plane, and $\theta_{bg}$ is an angle of convergence of each concentric channel.

2. The device of claim 1, wherein fluid one is air.

3. The device of claim 1, further comprising an air compressor and a metering valve for controlling delivery of the first fluid to the bubble generator.

4. The device of claim 1, further comprising a metering valve controlling delivery of the first fluid to the bubble generator, and wherein the first fluid is a compressed gas.

5. The device of claim 1, further comprising a portable pump connected to deliver the first fluid to the bubble generator.

6. The device of claim 5, wherein the pump is a piston pump.

7. The device of claim 5, further comprising a a flexible reservoir connected between the pump and the converging channels of the bubble generator.

8. The device of claim 1, wherein the second fluid is a solution, suspension, emulsion, or mixture thereof containing a surface active ingredient.

9. The device of claim 1, further comprising a liquid flow controlled pump connected to deliver the second fluid to the bubble generator.

10. The device of claim 9, wherein the pump is a syringe pump or a peristaltic pump.

11. The device of claim 1, further comprising on/off switches connected between each fluid and the bubble generator.

12. The device of claim 1, further comprising:

one or more additional bubble generators, wherein all bubble generators are configured in an array;

a first distribution channel delivering the first fluid to all bubble generators;

a second distribution channel delivering the second fluid to all bubble generators; and wherein exits of all bubble generators are in a planar arrangement such the the array produces bubbles or foam.

13. The device of claim 12, wherein the bubble generators are arranged linearly in the array.

14. The device of claim 12, wherein the bubble generators are arranged in a grid in the array.

15. The device of claim 12, wherein the bubble generators are positioned to create interfering first fluid streams, producing multiple bubble sizes from the array.

16. The device of claim 12, further comprising a first pump and/or a first flow rate regulator on the first distribution channel and a second pump and/or a second flow rate regulator on the second distribution channel, wherein flow control through the pumps and/or flow rate regulators alters output bubble and foam properties including time of persistence and wetness.

17. The device of claim 12, wherein the geometry of the exit channels is different between at least two bubble channels of the array, resulting in output of multiple bubble sizes.

18. The device of claim 17, wherein the bubble generator differences are arranged such that produced bubble output exhibits preferred crystalline packing arrangements.

19. The device of claim 17, wherein the bubble generator geometry differences are arranged such that 80% of the bubble generators produce a unimodal larger bubble, and 20% of the bubble generators produce a unimodal smaller bubble.

20. The device of claim 1, further comprising:

one or more additional bubble generators, wherein all bubble generators are configured in an array;

a first distribution channel delivering the first fluid to all bubble generators;

a second distribution channel delivering the second fluid to one or more of the bubble generators;

one or more additional fluids liquid;

one or more additional distribution channels delivering additional fluids to one or more of the bubble generators;

wherein each bubble generator is delivered one fluid from the second fluid and the one or more additional fluids; and wherein exits of all bubble generators are in a planar arrangement such the the array produces bubbles or foam.

21. The device of claim 20, wherein the bubble generators are positioned to create interfering first fluid streams, producing multiple bubble sizes from the array.

22. The device of claim 20, further comprising a first pump and/or a first flow rate regulator on the first distribution channel, a second pump and/or a second flow rate regulator on the second distribution channel, and one or more additional pumps and/or one or more additional flow rate regulators on the one or more additional distribution channels, wherein flow control through the pumps and/or flow rate regulators alters output bubble and foam properties including time of persistence and wetness.

23. The device of claim 20, wherein the geometry of the exit channels is different between at least two bubble channels of the array, resulting in output of multiple bubble sizes.

24. The device of claim 23, wherein the bubble generator alignment and geometry differences are arranged such that produced bubble output exhibits preferred crystalline packing arrangements.

25. The device of claim 23, wherein the bubble generator geometry differences are arranged such that 80% of the bubble generators produce a unimodal larger bubble, and 20% of the bubble generators produce a unimodal smaller bubble ("80/20 packing") or similarly optimized ratio.

* * * * *